252-99
7/6/76
AU 165 EX
XR 3,968,047

United States Patent [19]

Smeets

[11] 3,968,047

[45] July 6, 1976

[54] DETERGENT COMPOSITIONS

[75] Inventor: Fred Smeets, Tiennen, Belgium

[73] Assignee: Citrex, Société Anonyme, Brussels, Belgium

[22] Filed: Feb. 28, 1974

[21] Appl. No.: 447,039

[30] Foreign Application Priority Data

Mar. 1, 1973 United Kingdom ..... 9937/73

[52] U.S. Cl. ..... 252/95; 252/99; 252/538; 252/546; 252/552; 252/557; 252/DIG. 1; 260/535 P

[51] Int. Cl.[2] ..... C11D 3/395; C11D 7/54

[58] Field of Search ..... 252/95, 557, 538, 552, 252/99, DIG. 15, DIG. 1; 260/535 P

[56] References Cited

UNITED STATES PATENTS

| | | | |
|---|---|---|---|
| 3,586,715 | 6/1971 | Smeets | 260/535 P |
| 3,862,965 | 1/1975 | Werner et al. | 252/557 |

*Primary Examiner*—Thomas J. Herbert, Jr.
*Attorney, Agent, or Firm*—Wenderoth, Lind & Ponack

[57] ABSTRACT

A detergent composition which comprises a. 1 to 99, preferably 1 to 30, parts by weight of a salt of an organic sulfopolycarboxylic acid, the carboxyl groups of which are at least partially esterified with at least one non-ionic compound containing at least one hydroxyl group and the sulfonic acid group of which is salified with a cation selected from sodium, potassium and triethanolamine, said sulfopolycarboxylic acid being obtained by sulfonating and acidifying the pyrolysis product of an alkaline earth metal salt of citric acid, and b. 99 to 1, preferably 99 to 70, parts by weight of sodium and/or potassium sulfate and optionally at least one component selected from the group consisting of an anionic surfactant, a non-ionic surfactant, a bleaching agent, an alkali metal silicate, a stabilizer, a polyelectrolyte, adjuvants, water and an abrasive.

24 Claims, 2 Drawing Figures

DETERGENT COMPOSITIONS

Figure 1:
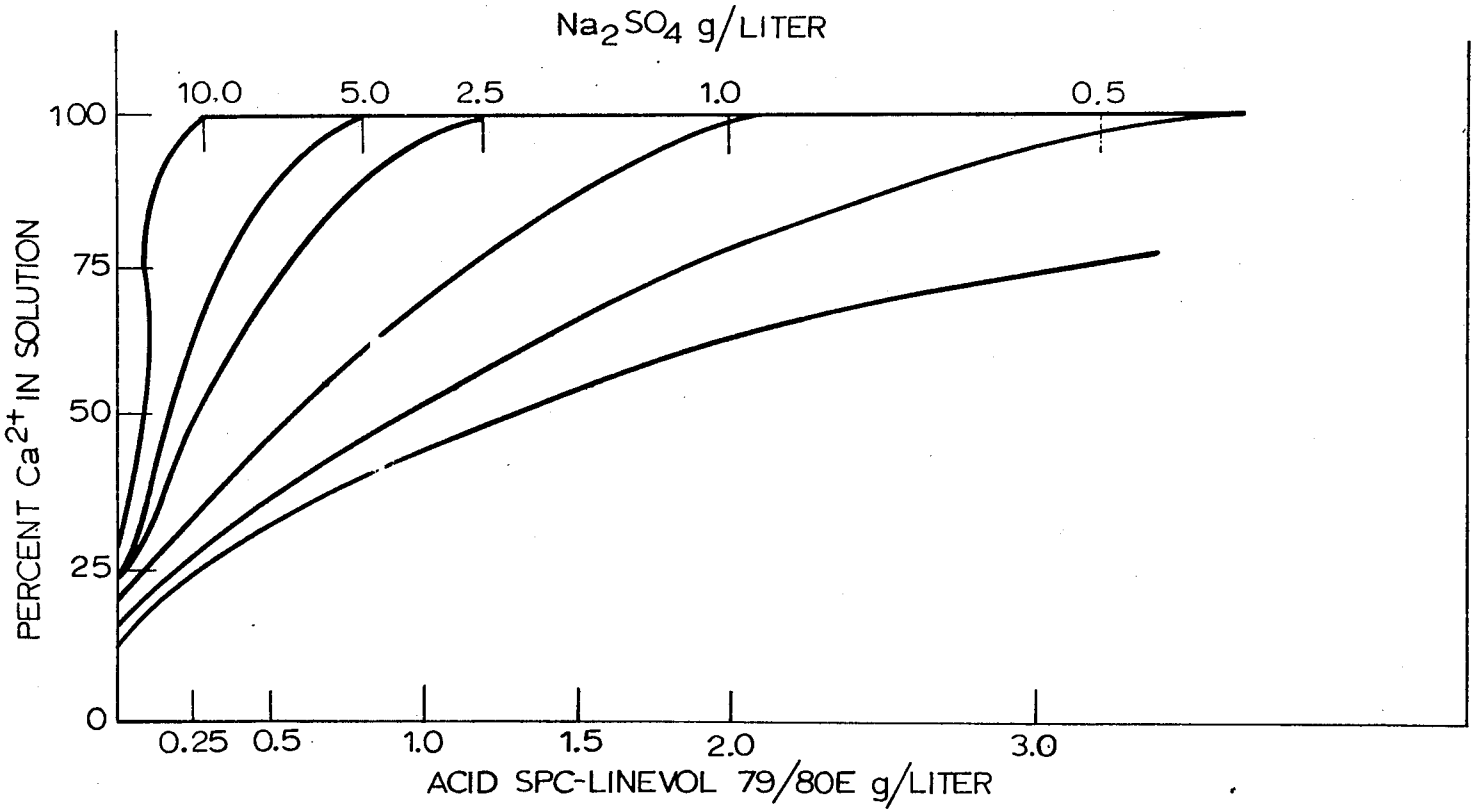

The present invention is concerned with a detergent composition and, more particularly, with a detergent composition which does not contain alkali metal polyphosphates but nevertheless inhibits the precipitation of agents responsible for the hardness of water.

The expression "detergent composition" is to be understood in its widest sense. It includes compositions used for preventing the precipitation of calcareous deposits on the walls of industrial and domestic heating equipment, i.e. water softening agents, and also washing compositions, for example, washing powders for natural and synthetic textiles which may or may not contain per compounds and/or enzymes, compositions for scouring articles having hard surfaces (dishes, windows, floor tiles, automobile bodies and the like). This detergent composition may be in the physical forms usual for this kind of use, namely, powder, granulate, gel, paste, solution, emulsion, suspension or the like.

The problem of pollution, in general, and the problem of pollution of static and running waters, in particular, are receiving more and more attention. Among the sources of pollution, that, caused by the massive use of detergent compositions (in the sense defined above), is particularly critical. These compositions normally contain alkali metal polyphosphates which, according to studies carried out in numerous countries, contribute towards the phenomenon of proliferation of aquatic algae which is known in the scientific world by the name "eutrophization". In addition, detergent compositions often contain nitrogenous compounds which participate in the metabolism of microorganisms and, therefore, promote their multiplication. Among the surfactants used in detergent compositions, some have been found to be toxic towards higher organisms, including fish. Various substances used in detergent compositions are not biodegradable and, consequently, tend to accumulate in waters to such an extent as to destroy gradually all life in lakes and rivers. Finally, because of the presence of constituents of detergent compositions in these waters, the latter become unfit for human consumption and for industrial use.

It is for these reasons that numerous attempts have been made to discover new detergent compositions which pollute waters as little as possible.

The most general course adopted to eliminate, or at least to reduce to a minimum, the content of alkali metal polyphosphates in detergent compositions in order to end the phenomenon of eutrophization but the results obtained have so far been found to be highly disappointing from the point of view of the properties required of detergent compositions. Alkali metal polyphosphates are, in fact, valuable cleaning agents which intervene very favourably in cleaning, washing and other operations by improving detergency and preventing the precipitation of agents responsible for the hardness of water, especially calcium and magnesium ions. Attempts have been made to use various substitutes for alkali metal polyphosphates, particularly sequestering agents. Nitrilotriacetic acid (NTA), which forms complexes with heavy metal cations, is not a promising substitute for sodium tripolyphosphate (TPP) because, rightly or wrongly, carcinogenic properties are attributed to it and because it bonds the trace elements necessary for the metabolism of aquatic organisms. Sodium citrate is a complexing agent which is practically devoid of toxicity but, to enable it to replace TPP in detergent composition formulations, it would be necessary to use it in such an amount that costs would be increased to an intolerable extent. Polyelectrolytes, such as sodium polyacrylate, are very expensive and, in addition, they are not biodegradable, so that their large-scale use as a substitute for TPP would be a new source of pollution. Manufacturers have even thought of returning to earlier formulations of detergent compositions containing fatty acid soaps but modern washing and cleaning methods are no longer suitable for their use, one reason being the precipitation of alkaline earth soaps on garments washed, while another reason is that fatty acid soaps are found to be ineffective for washing the synthetic textiles at present on the market. Attempts have also been made to replace alkali metal polyphosphates by sodium carbonate but the success of this measure is only partial. Although the detergent power of compositions containing sodium carbonate is relatively good in the case of cotton, because of the very high pH imparted to the cleaning bath, their use gives rise to certain disadvantages, among which the following may be mentioned:

1. An increase in precipitation of calcareous material, which is deposited on garments washed and on the walls of washing machines.
2. They attack and damage certain fabrics because of their high alkalinity.
3. Harmful action on the skin, which is characteristic of alkalis.
4. Lack of detergency for synthetic fibre fabrics, particularly polyester fibres.
5. They are dangerous if accidentally swallowed, particularly by children.

The object of the present invention is to provide a non-polluting or substantially non-polluting detergent composition which does not contain polyphosphate and from which the substances hitherto used to replace polyphosphates have been completely or partially eliminated, i.e. in which the use of substantial amounts of alkalis (carbonates and strongly alkaline silicates), complexing agents, polyelectrolytes and the like, is avoided but which, nevertheless, has good technological properties for the softening of water, washing of clothes, scouring of articles and the like.

According to the present invention, this object is achieved as the result of the discovery of synergism between two substances, namely (a) a salt of a sulfopolycarboxylic acid (as defined hereinafter) in which the carboxyl groups are partly or, preferably, completely esterified by at least one non-ionic compound containing at least one hydroxyl group, and (b) sodium sulfate and/or potassium sulfate, preferably sodium sulfate.

This discovery, which in itself is surprising, permits complete replacement of TPP in detergent compositions both in respect of actual detergent properties and in respect of inhibition of the precipitation of agents responsible for the hardness of water. According to biological tests, the substance (a) is biodegradable and its toxicity for fish is from one-fifth to one-tenth that of surfactant compounds normally used in detergent compositions, such as the biodegradable alkali metal alkylbenzene-sulfonates. Sodium sulfate and/or potassium sulfate (b) are, in turn, not toxic materials in the amounts used and do not increase the pH value of baths containing them; in addition, where sodium sulfate is concerned, its moderate cost and ready availability permit its use in large amounts in the detergent composition according to the present invention.

In addition to the physical combination of substances (a) and (b), the detergent composition of the present invention may obviously contain the various constituents generally found in this type of composition, while, however, taking care to include in it only constituents devoid of toxicity or, if these constituents are toxic, they must be used in sufficiently small amounts to ensure that the advantages provided by the synergic combination of the present invention are not lost.

The detergent composition according to the present invention consequently comprises two essential components (a) and (b), namely:

a. at least one sulfopolycarboxylic acid salt (as defined hereinafter) in which the carboxyl groups are partly or, preferably, completely esterified by at least one non-ionic compound containing at least one hydroxyl group, representing 1 to 99, preferably 1 to 30 parts by weight, and b. sodium sulfate and/or potassium sulfate representing 99 to 1, preferably 99 to 70 parts by weight, the sum of amounts of the components (a) and (b) representing always 100 parts by weight.

However, in addition to the essential components (a) and (b) mentioned hereinabove, the detergent composition according to the invention may contain at least one of the following optional components:

c. anionic surfactant,
d. non-ionic surfactant,
e. per compound,
f. alkali metal silicate,
g. stabilizer,
h. polyelectrolyte,
i. adjuvants (colouring matter, scent, thickener, optical bleaching agent, anti-corrosive agent, anti-dulling agent, foam inhibitor, pH buffer agent, for example borax, disinfectants, or the like,
j. water and
k. abrasive.

Sulfopolycarboxylic acid (SPC) used for preparing the abovementioned component (a) is the product obtained by sulfonating and acidifying the pyrolysis product prepared by heating an alkaline earth metal salt of citric acid to a temperature within the range from 250°to 400°C for a period of time until an increase in titratable alkalinity of the reaction mixture is obtained and until not more than 32% of the original citric acid salt remains in the reaction mixture, as described in U.S. Patent No. 3,586,715, which is here incorporated by way of reference. This SPC acid is used as raw material for preparing component (a) by the process described in British Patent Specification No. 1,165,788, which is likewise incorporated here by way of reference, i.e., by partial or, preferably, complete esterification of the carboxyl groups of this acid by at least one non-ionic compound containing at least one hydroxyl group and by salification of the sulfonic acid group of this acid by sodium, potassium, or triethanolamine. The component (a) is, therefore, a sodium, potassium or triethanolamine salt of the SPC acid described above in which the carboxyl groups have been partially or, preferably, completely esterified by at least non-ionic compound containing at least one hydroxyl group which is preferably selected from the group consisting of an aliphatic alcohol containing from 4 to 24 carbon atoms and an alkylphenol containing from 8 to 15 carbon atoms in the alkyl radical, the said aliphatic alcohol or alkylphenol having been alkoxylated with 1 to 50 moles of $C_2$–$C_3$ alkylene oxide per mole of aliphatic alcohol or alkylphenol.

An important requirement for the effectiveness of component (a) is that it should be soluble in water. In this respect, the role of the hydroxy group-containing non-ionic compound used for partially or completely esterifying the carboxyl groups of the SPC acid defined above is a decisive factor. A hydroxy group-containing non-ionic compound of the class specified above in (a) contains a hydrophobic radical, i.e. the alkyl or alkylphenyl radical, and a hydrophilic radical, i.e. the oxyalkylated chain. If the component (a) is to have good solubility in water, the weight ratio between the hydrophobic radical and the hydrophilic radical of the non-ionic compound must be carefully chosen. The greater the number of carbon atoms contained in the hydrophobic radical, the greater the number of oxyalkylene units there must be in the hydrophilic radical to impart solubility in water to the component (a).

A second requirement is that the carboxyl groups of the SPC acid used according to the present invention should be partially or, preferably, completely esterified by at least one hydroxy group-containing non-ionic compound of the type defined above, since the precipitation inhibiting power of the component (a), in combination with the component (b), towards, the heavy cations, appears to be bound up with the esterification ratio.

Finally, component (a) may consist of an SPC acid ester salt or, preferably, of a mixture of a plurality of such salts which differ from one another in respect of the hydroxy group-containing non-ionic compound; similarly, the SPC acid ester salt may have been esterified by a single non-ionic hydroxy group-containing compound or by a plurality of such compounds which differ from one another in respect of their hydrophobic radical and/or in respect of their hydrophilic radical.

The sodium sulfate and/or potassium sulfate (b) may be in anhydrous form or in a form containing water of crystallization. In addition, it may be chemically pure or of normal industrial quality. Nevertheless, for the purpose of calculating the sodium sulfate and/or potassium sulfate content of the composition, reference is always made herein to the anhydrous salt.

The anionic surfactant (c) is, for example, a fatty acid soap containing from 10 to 30 carbon atoms, an alkyl sulfonate containing from 8 to 25 carbon atoms, a secondary alkylsulfate having 10 to 18 carbon atoms, an alkylbenzene-sulfonate containing from 10 to 18 carbon atoms in the alkyl radical, a primary alkyl sulfate containing from 8 to 18 carbon atoms, an alkylpolyoxyethylene-ether sulfate or an alkylaryl-polyoxyethylene-ether sulfate, in which the alkyl radical contains from 8 to 18 carbon atoms and in which the polyoxyethylene group contains from 1 to 10 units of ethylene oxide, or a sulfopolycarboxylic acid ester salt similar to component (a) but in which the sulfopolycarboxylic acid is sulfosuccinic acid or sulfotricarballylic acid. The anionic surfactant (c) is an optional component in the detergent composition according to the invention; if present, 1 to 25, preferably 3 to 10 parts by weight thereof are used per 100 parts by weight of the sum of (a) and (b).

The non-ionic surfactant (d) is, for example, an alkylphenol containing 6 to 15 carbon atoms in the alkyl radical and ethoxylated by from 3 to 50 moles of ethylene oxide per mole of alkylphenol, an aliphatic alcohol containing from 8 to 22 carbon atoms and ethoxylated by from 3 to 50 moles of ethylene oxide per mole of alcohol, a fatty acid ethanolamide containing from 10 to 22 carbon atoms or a fatty acid ethanolamide containing from 10 to 22 carbon atoms and ethoxylated by from 0.5 to 20 moles of ethylene oxide. The non-ionic surfactant (d) is not an essential component in the detergent composition according to the invention; if present, 1 to 25, preferably 2 to 10 parts by weight thereof are used per 100 parts by weight of (a) + (b).

The per compound (e) can be, for example, hydrogen peroxide, an alkali metal persulfate, percarbonate, persilicate or the like, preferably sodium perborate, of the quality generally used in washing and cleaning compositions. The use of the per compound (e) in the detergent composition according to the invention is optional; if present, 1 to 35, preferably 15 to 25 parts by weight thereof are used per 100 parts by weight of (a) + (b).

The alkali metal silicate (f) is generally a sodium or potassium silicate in which the $SiO_2/M_2O$ ratio is from 1:4 to 4:1, M being sodium or potassium. The alkali metal silicate (f) is an optional component in the detergent composition according to the invention; if present, 1 to 10 preferably 3 to 6 parts by weight thereof are used per 100 parts by weight of (a) + (b).

The stabilizer (g) is generally an organic sequestering agent normally used in washing and cleaning compositions, for example, an alkali metal salt of ethylene-diamine-tetracetic acid (EDTA), of nitrilotriacetic acid (NTA), of diethylene-triamine-pentaacetic acid (DTPA), of a hydroxypolycarboxylic acid, such as sodium citrate, or of a polycarboxylic acid, such as sodium diglycolate or the like. The stabilizer (g) may, however, also be a mineral compound, for example magnesium silicate or the like. The stabilizer (g) is not a compulsory component in the detergent composition according to the invention; if present, 0.1 to 10, preferably 0.2 to 2 parts by weight thereof are used per 100 parts by weight of (a) + (b).

The polyelectrolyte (h) can be, for example, an alkali metal salt of an acid such as polyacrylic acid, a copolymer of maleic anhydride with ethylene, or a copolymer of maleic anhydride with methyl-vinyl-ether, a polymerized hydroxycarboxylic acid or the like. The polyelectrolyte (h) is an optional component in the detergent composition according to the invention; if present, 0.1 to 5, preferably 0.5 to 3 parts by weight thereof are used per 100 parts by weight of (a) + (b).

The adjuvants (i) include, for example, colouring matters, scents, thickening agents; such as carboxymethyl-cellulose, polyvinylpyrrolidone, polyvinyl alcohol or the like, optical bleaching agents, for example of the stilbene series, anti-corrosion and/or anti-dulling agents, anti-foaming agents, pH buffer agents, disinfectants and the like. The adjuvants (i) are optionally used in the detergent compositions according to the invention; if present, 0.1 to 15, preferably 0.2 to 10 parts by weight thereof are used per 100 parts by weight of (a) + (b).

Water (j) is an optional component of the detergent composition of the present invention. The water content may be zero in the case of an anhydrous powder and will be higher or lower, depending upon whether the composition is in the form of a wet powder, paste, gel, solution, emulsion, suspension or the like. The water may consist of free water, constituting the humidity of the composition, or of water bonded to one or more components of the composition as water of crystallization. The amount of water in the composition according to the invention, when present, is 0.1 to 1000, preferably 2 to 950 parts by weight per 100 parts by weight of (a) + (b).

The abrasive (k) is used particularly in the case of scouring compositions according to the present invention. It can be at least one of the following abrasive substances normally used in compositions of this kind: diatomaceous earth, volcanic ash, pumice stone, quartz, feldspar, marble, bentonite, sand, talc or the like, in particles, the size of which is below 80 microns. The abrasive (k) is not a compulsory component of the detergent composition according to the invention; if present, it might amount to 0.1 to 1000, preferably 5 to 950 parts by weight per 100 parts by weight of (a) + (b).

To summarize, the detergent composition of the present invention contains two essential components, namely the SPC acid ester salt (a) and sodium sulfate and/or potassium sulfate (b), the other components (c) to (k) being optional and being present only in accordance with the purpose for which the composition of the present invention is intended, for example, as a water softening agent, as a textile washing agent; as a scouring agent or the like, and in accordance with the physical nature of the composition (solid, liquid, paste or the like). The SPC acid ester salt (a) serves two purposes in the composition of the present invention: due to its very nature, it is an anionic surfactant having detergent properties and, in physical combination with sodium sulfate and/or potassium sulfate, it replaces the alkali metal polyphosphates for the purpose of preventing the precipitation of salts having heavy metal cations, such as calcium and magnesium ions, present in hard water.

The quantity of composition of the present invention to be used varies widely, depending upon a number of factors. For example, if the composition is used for softening water, the amount added will vary in accordance with the hardness of the water and the minimum amount which completely prevents the precipitation of insoluble salts will be used. If the composition is used for washing textiles, the quantity will vary, not only depending upon the hardness of the water but also depending upon the technique used for the washing, particularly upon the temperature of the washing liquid. Thus, by way of example, in countries where textiles are washed at a relatively low temperature, which does not entail the conversion of calcium bicarbonate and/or magnesium bicarbonate into the corresponding insoluble carbonate, as in the United States of America and Japan, the quantity may be from 1 to 2 grams per liter of bath and the same will be true if the composition of the present invention is used in regions where the hardness of the water is low. On the other hand, in countries where textiles are washed at a relatively high temperature, particularly Europe, and where the water used for washing is relatively hard, the amount may be as much as 20 grams per liter of bath.

When each of the components (a) and (b), is used singly, it effects only an insignificant inhibition of the precipitation of agents responsible for the hardness of the water; this precipitation is however practically completely eliminated when they are both used in combination in the proportions specified above and they achieve this with a combined amount which is considerably smaller than the total of individual amounts;

consequently, it is clear that the phenomenon of synergism occurs here.

This phenomenon of synergism is unexpected because it is peculiar to the association of the component (a) with the component (b); tests have shown that the usual surfactants, such as the alkylbenzene sulfonates, the alkyl sulfates, the ethoxylation products of an aliphatic alcohol or of an alkylphenol or the like when combined with the constituent (b) do not exhibit, under the same conditions, a sufficiently great synergistic effect to enable any practical use to be made thereof.

In the following Examples, the tests were carried out with the top water of the town of Tienen (Belgium), which has a very high hardness, as shown by the following Table (French hydrotimetric degrees: hardness being expressed in ppm calcium carbonate per liter):

| Total hardness | | | Permanent hardness | | | Temporary hardness | | |
|---|---|---|---|---|---|---|---|---|
| $(Ca^{2+}+/Mg^{2+})$ | $Ca^{2+}$ | $Mg^{2+}$ | $(Ca^{2+}+/Mg^{2+})$ | $Ca^{2+}$ | $Mg^{2+}$ | $(Ca^{2+}+/Mg^{2+})$ | $Ca^{2+}$ | $Mg^{2+}$ |
| 402.3 | 342.2 | 60.7 | 122.7 | 72.0 | 50.7 | 280.2 | 270.2 | 10.1 |

In order to determine the anti-precipitant power of the compositions tested, one or other of the following methods was used:

1. $Ca^{2+}$ dispersion method

A determined quantity of the detergent composition to be tested is added to a known quantity of natural water, the $Ca^{2+}$ content of which is known, the pH value is adjusted to 9 and the resulting mixture is boiled under reflux for 30 minutes. It is then allowed to cool and the percentage of $Ca^{2+}$ remaining dissolved after filtration through a Watman 2V filter is determined. Determination of $Ca^{2+}$ is carried out by complexometric titration and/or by flame spectrophotometry. The precision of the method is 2–3%.

2. Method of precipitation of $Ca^{2+}$ on a heating element

This method is very valuable because it makes it possible to predict the amount of calcareous deposits which may be formed on elements coming into contact with the washing liquid during heating in washing machines.

Starting with a known volume of tap water (4 liters), a known quantity of the composition to be tested is added. The bath formed in this way is placed in a container provided with an agitator and a thermometer and an electric heating element is immersed in the bath to bring the temperature of the bath to 98°C. within 30 minutes and to maintain it at that value for 10 minutes.

The bath is then allowed to cool for 30 minutes and the heating element is withdrawn from the bath and rinsed twice in water, this test being repeated 5 times in all and the amount of calcium salt deposited on the heating element is then measured by dissolving it in 0.5N hydrochloric acid.

It will be understood that, in the first method, the higher the numerical values of the percentage of $Ca^{2+}$ not precipitated, the better the composition tested, whereas, on the contrary, in the second method, the lower the value given for the deposit formed on the heating element, the better the anti-precipitation effect of the composition tested.

The following Examples are given for the purpose of illustrating the present invention.

EXAMPLE 1

By the analytical $ca^{2+}$ dispersion method described above, the percentage of calcium ions is determined, that remains dissolved in hard water in the single presence of each of the following various components:

| | g/liter | % of $Ca^{2+}$ remaining in solution |
|---|---|---|
| $Na_2SO_4$ | 0 | 16.9 |
| | 5 | 28.1 |
| | 10 | 41.6 |
| LAS* | 1 | 37.8 |
| FAS** | 1 | 8.6 |
| Tergitol 15S9*** | 1 | 10.4 |
| Dobanol 45-11 EO**** | 1 | 9.3 |
| Empilan KM25***** | 1 | 13.7 |
| SPC Acid-Linevol 79-8 EO****** | 1 | 43.3 |

*sodium dodecylbenzene sulfonate
**sodium salt of a mixture of sulfated $C_{16}$—$C_{18}$ natural alcohols
***mixture of unbranched $C_{11}$—$C_{15}$ alcohols ethoxylated with 9 moles of ethylene oxide (EO)
****mixture of unbranched $C_{11}$—$C_{15}$ alcohols ethoxylated with 11 moles of ethylene oxide
*****mixture of natural $C_{16}$—$C_{18}$ fatty alcohols ethoxylated with 25 moles of ethylene oxide
******component (a) according to the present invention obtained by esterification of the carboxyl groups of SPC acid with Linevol 79-8 EO (mixture of $C_7$—$C_9$ primary alcohols ethoxylated with 8 moles of ethylene oxide) and neutralization of the sulfonic acid group with sodium hydroxide.

This Example shows that sodium sulfate, when used alone, like the various previously mentioned surfactants when used alone, prevents the precipitation of $Ca^{2+}$ only to an insufficient extent.

EXAMPLE 2

The $Ca^{2+}$ remaining in solution is determined as in Example 1. A comparison is here made of the behaviour of LAS and of the SPC acid-Linevol 79-8 EO mentioned in Example 1, when each of them is used in the presence of sodium sulfate.

| | | % of $Ca^{2+}$ in solution | |
|---|---|---|---|
| | | $Na_2SO_4$ (5 g/l) | $Na_2SO_4$ (10 g/l) |
| LAS (g/l) | 0.25 | 47.4 | 53.8 |
| | 0.50 | 57.6 | 65.2 |
| | 1.00 | 73.0 | 66.7 |
| SPC | 0.25 | 57.0 | 100.0 |
| Acid-Linevol | 0.50 | 96.9 | 100.0 |
| 79-8 EO | 1.00 | 98.8 | 100.0 |

This Table clearly shows the synergistic effect of the combination according to the present invention (SPC acid-Linevol 79-8 EO + $Na_2SO_4$) in the inhibition of the precipitation of the calcium ions contained in hard water. LAS, which is not in accordance with the present invention, does not exhibit any synergistic effect but only a simple additive effect.

EXAMPLE 3

The same method of determination of calcium ions remaining in solution was used in Examples 1 and 2. Here there is shown the antiprecipitant power of the SPC acid-Linevol 79-8 EO + $Na_2SO_4$ system according to the present invention when the concentration of SPC-Linevol 79-8 ED is varied between 0 and 3 grams per liter and the concentration of sodium sulfate between 0 and 10 grams per liter. The results of these tests are shown in graph of FIG. 1 of the accompanying drawings, which clearly shows that, for a given anti-precipitant effect, the concentration of SPC acid-Linevol 79-8 EO decreases with increasing concentration of sodium sulfate.

EXAMPLE 4

In this Example, the rate of esterification of the carboxyl groups of SPC acid by Linevol 79-8 EO is varied and the calcium ion precipitation preventing power is determined as in the preceding Examples. Sodium sulfate at the rate of 5 grams per liter and the sodium salt of the sulfopolycarboxylic acid ester examined, at the rate of 0.5 grams liter, are added to the hard water. The results obtained are as follows:

| Esterification rate (%) | % of $Ca^{2+}$ remaining in solution |
|---|---|
| 100 | 96.9 |
| 75 | 94.8 |

EXAMPLE 5

This Example shows the influence of the nature of the hydroxy group-containing non-ionic compound (used for esterifying SPC acid) on the calcium ion precipitation inhibiting power of a combination comprising component (a) and component (b) according to the present invention. The anti-precipitant power is measured as in Examples 1 to 4. In all the tests of this Example, 5 g/l of sodium sulfate are added to the hard water.

In a first series of tests, the length of the hydrophobic radical of the non-ionic compound is varied while the length of the hydrophilic radical is kept unchanged (at an arbitrary value of 6 moles of ethylene oxide). It is then determined what concentration in grams per liter of the sulfopolycarboxylic acid ester salt must be added to the hard water to maintain 100% of calcium ions in solution. The following Table is thus obtained:

| SPC acid esterified with: | Concentration in g/l of ester salt of SPC acid |
|---|---|
| $C_8$ alcohol - 6 ethylene oxide | > 1.0 |
| $C_8$—$C_{10}$ alcohols - 6 ethylene oxide | 0.5 |
| $C_8$—$C_{10}$ alcohols - 6 ethylene oxide | 0.6–0.7 |
| $C_9$—$C_{11}$ alcohols - 6 ethylene oxide | 0.6–0.7 |
| $C_{10}$—$C_{14}$ alcohols - 6 ethylene oxide | 1.25 |
| $C_{16}$—$C_{18}$ alcohols - 6 ethylene oxide | 1.5 |

In a second series of tests, the hydrophobic radical is kept fixed (mixture of $C_7$–$C_9$ alcohols) and the length of the oxyethylated chain is varied. In each case, 0.5 g/l of the SPC acid ester salt is added and the percentage of calcium ions remaining in solution is determined, the results obtained being shown in the following Table:

| SPC acid esterified with: | | % of $Ca^{2+}$ in solution |
|---|---|---|
| $C_7$—$C_9$ alcohol - | 0 EO | 71.4 (partially insoluble) |
| " | 4 EO | 99.1 |
| " | 6 EO | 97.1 |
| " | 8 EO | 96.6 |
| " | 10 EO | 79.0 |

This Example shows, therefore, that the nature of the hydroxy group-containing containing non-ionic compound has an influence on the anti-precipitant power of the component (a) according to the present invention and that this should be taken into account in accordance with the use for which the composition of the present invention is intended, while it should also be borne in mind that other factors may also need consideration, particularly detergency which varies with the chain length of the hydrophobic radical and solubility in water which varies with the chain length of the hydrophilic radical of the hydroxy group-containing containing non-ionic compound used.

EXAMPLE 6

This Example shows that the salts of the lower homologues of SPC acid (sulfosuccinic acid and sulfotricarballylic acid), the carboxyl groups of which have been esterified with the same hydroxy group-cotaining non-ionic compound as was used for SPC acid in Example 1 (Linevol 79-8 EO), do not exhibit synergistic properties in association with sodium sulfate. Nevertheless, if each of these two lower sulfocarboxylic acid ester salts are associated with the SPC acid ester salt of Example 1, the anti-precipitant effect is considerably improved, as the following Table shows (5 g/l of sodium sulfate were previously added to the hard water):

| Product No. | obtained by esterification between: | g/liter | % of $Ca^{2+}$ remaining in solution |
|---|---|---|---|
| 1 | SPC acid + Linevol 79-8 ethylene oxide | 0.25 | 57.0 |
| | | 0.50 | 96.6 |
| 2 | sulfosuccinic acid + Linevol 79-8 ethylene oxide | 0.25 | 29.9 |
| | | 0.50 | 32.0 |
| 3 | 50/50 mixture by weight of 1 and 2 | 0.50 | 95.1 |
| 4 | sulfotricarballylic acid + Linevol 79-8 ethylene oxide | 0.25 | 30.0 |
| | | 0.50 | 34.2 |
| 5 | 50/50 mixture by weight of 2 and 4 | 0.50 | 38.0 |
| 6 | 50/50 mixture by weight of 1 and 4 | 0.50 | 84.0 |

EXAMPLE 7

This Example shows that it may be advantageous to use simultaneously two or more different sulfopolycarboxylic acid ester salts according to the present invention (same experimental conditions as in Example 6).

| Product No. | obtained by esterification between: | g/liter | % of $Ca^{2+}$ remaining in solution |
|---|---|---|---|
| 1 | SPC acid + Linevol | 0.40 | 98.5 |
| | 79-6 EO* | 0.50 | 100.2 |
| 2 | SPC acid + Dobanol | 0.40 | 81.8 |
| | 91-6 EO** | 0.50 | 89.2 |
| 3 | 50/50 mixture by weight | 0.40 | 99.7 |
| | of 1 and 2 | 0.50 | 100.2 |

*$C_7$—$C_9$ alcohols ethoxylated with 6 moles of ethylene oxide
**$C_9$—$C_{11}$ alcohols ethoxylated with 6 moles of ethylene oxide

EXAMPLE 8

This Example shows that potassium sulfate has an activity comparable with that of sodium sulfate in its action inhibiting the precipitation of calcium ions, when it is associated with the sulfopolycarboxylic acid ester salts according to the present invention. For the tests, use is made of the sodium salt of SPC acid in which the carboxyl groups have been esterified with Linevol 79-8 EO (as in Example 1).

| Alkali metal sulfate | g/liter | concentration in g/liter of SPC acid-Linevol 79-8 EO | | |
|---|---|---|---|---|
| | | 0 | 0.5 | 1.0 |
| | | % of $Ca^{2+}$ remaining in solution | | |
| $Na_2SO_4$ | 2.5 | 16.9 | 74.3 | 96.4 |
| | 5.0 | 28.1 | 96.6 | 98.8 |
| | 10.0 | 41.6 | 100.0 | 100.0 |
| $K_2SO_4$ | 2.5 | — | 73.8 | 96.4 |
| | 5.0 | — | 84.6 | 100.3 |
| | 10.0 | 31.4 | 100.0 | 101.2 |

EXAMPLE 9

Three washing powder compositions are prepared which differ from one another solely by the nature of the surfactant used and the anti-precipitant power of these compositions in relation to calcium ions is determined by the heating element method described previously. These washing powders are used in an amount of 5 grams per liter of hard water. The results shown in the Table below bring out the excellent anti-precipitant power of composition (1) according to the present invention:

| Ingredients | Composition (1) | Composition (2) | Composition (3) |
|---|---|---|---|
| Sodium perborate tetrahydrate | 20% | 20% | 20% |
| Magnesium silicate | 2% | 2% | 2% |
| Monosodium citrate | 3% | 3% | 3% |
| EDTA | 0.4% | 0.4% | 0.4% |
| Carboxymethylcellulose, polyvinylpyrrolidone, optical bleaching agent | 2% | 2% | 2% |
| SPC acid-Linevol 79-8 EO | 15% | — | — |
| Tergitol 15 S 7* | — | 15% | — |
| LAS** | — | — | 15% |
| Anhydrous sodium sulfate | balance | balance | balance |
| Number of mg. of calcium deposited on the submerged portion of the heating element | | | |

-continued

| Ingredients | Composition (1) | Composition (2) | Composition (3) |
|---|---|---|---|
| after the 5th test | 14.0 | 157.5 | 186.9 |

*$C_{11}$—$C_{15}$ alcohols ethoxylated with 7 moles of ethylene oxide
**Sodium salt of dodecylbenzene sulfonate.

EXAMPLE 10

Here the calcium ion precipitation inhibiting power of three washing powders is compared, namely:

I. composition (1) of Example 9 according to the present invention;
II. the same composition without SPC acid/Linevol 79-8 EO;
III. a commercial composition without sodium tripolyphosphate, containing sodium carbonate and sodium silicate, this composition having a highly alkaline pH (pH = 10.0–10.5).

Figure 2:
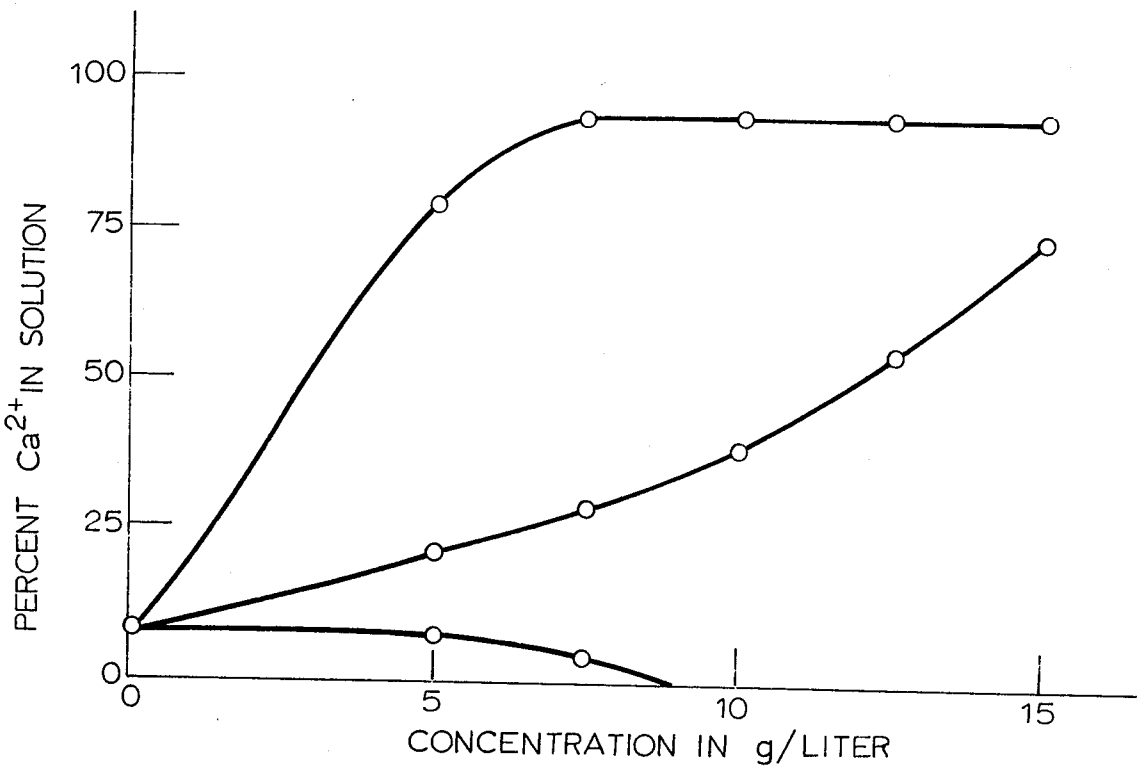

In the graph of FIG. 2 of the accompanying drawings are given the results of these tests, in which from 0 to 15 grams per liter of each of these three compositions is used, the percentage of calcium ions remaining in solution being determined by the $Ca^{2+}$dispersion method described previously. Comparison of the curves of compositions (I) and (II) shows, on the one hand, the advantageous effect of SPC acid-Linevol 79-8 EO on the calcium ion precipitation inhibiting power; on the other hand, when curve I is examined, it can be seen that the anti-precipitant power of the system comprising a surfactant and sodium sulfate according to the present invention reaches 100%, notwithstanding the presence of the other components of the composition. The curve of composition (III) shows that its anti-precipitant power is negligible and becomes zero at concentrations exceeding about 8 grams per liter.

EXAMPLE 11

Here are described detergency comparison tests between washing powders according to the present invention and commercially available washing powders.

Detergency is determined by measurement of light reflection by means of a reflectometer, using artificially soiled strips of fabric, these measurements being made before and after the washing of the strips.

The percentage of detergency is determined with the use of the following equation:

$$\% \text{ of detergency} = \frac{R_{after\ washing} - R_{before\ washing}}{92 - R_{before\ washing}} \times 100$$

R being the reflectance measured.

Bands of fabric used:
- of cotton:
  - U.S. Testing Corporation (U.S.T.C.)
  - Test Fabrics Corporation (T.F.C.)
  - Krefeld
  - Spängler (soiled in laboratory)
- of polyester/cotton:
  - Test Fabrics Corporation Test conditions:
- for cotton bands:
  - Launder-O-meter machine, tap water of the town of Tienen, diluted to 300 ppm of calcium carbonate, 4 grams of powder per liter of washing bath, washing time 15 minutes, bath temperature 85°C.

for bands of polyester/ cotton:

Tergot-O-meter machine, tap water of the town of Tienen, diluted to 300 ppm of calcium carbonate, 4 grams of powder per liter of washing bath, washing time 10 minutes, bath temperature 50°C.

Four washing powders according to the present invention are subjected to tests, their composition being as follows:

| | A | B | C | D |
|---|---|---|---|---|
| Sodium perborate | 20% | 20% | 20% | 20% |
| Alkali metal silicate | 5% | 5% | 5% | 5% |
| Optical brightening agent | 0.5% | 0.5% | 0.5% | 0.5% |
| Anti-redeposition agent | 1.5% | 1.5% | 1.5% | 1.5% |
| EDTA | 0.2% | 0.2% | 0.2% | 0.2% |
| Anti-foaming agent | 3.0% | 3.0% | 3.0% | 3.0% |
| 50/50 mixture of SPC acid-Linevol 79-6 EO and SPC acid-Dobanol 91-6 EO | 6% | 6% | 6% | — |
| 50/50 mixture of SPC acid-Alfol 810-6 EO and SPC acid-Dobanol 91-6 EO | — | — | — | 6% |
| LAS | 5% | 3% | — | — |
| FAS | 3% | 3% | — | — |
| Tergitol 15S7 | — | 3% | 8% | 8% |
| Sodium sulfate | balance | balance | balance | balance |

*Alfol 810-6 EO = product of oxyethylation of $C_8$—$C_{10}$ aliphatic alcohols with 6 moles of ethylene oxide.

and they are compared with three commercial washing powders E, F and G, the powders E and F containing sodium tripolyphosphate, while powder G contains sodium carbonate instead of sodium tripolyphosphate. The results obtained are shown in the following Table:

| Powder | U.S.T.C. | T.F.C. | Krefeld | Spangler | Polyester/ cotton T.F.C. |
|---|---|---|---|---|---|
| A | 10.6 | 28.4 | 31.4 | 48.0 | 27.8 |
| B | 12.5 | 28.8 | 34.7 | 51.3 | 28.6 |
| C | 18.8 | 37.5 | 51.3 | 47.5 | 34.5 |
| D | 14.8 | 32.2 | 57.0 | 40.3 | 35.5 |
| E | 8.4 | 28.2 | 65.3 | 60.5 | 26.3 |
| F | 12.2 | 33.8 | 66.9 | 63.8 | 35.1 |
| G | 6.1 | 24.7 | 37.5 | 55.5 | 10.3 |

In order to bring out more clearly the results of this Table, another Table is given below in which powder E, which is an excellent commercial washing powder containing sodium tripolyphosphate, is taken as reference powder and the results of the other powders are expressed as a percentage of the results obtained with powder E.

| Powder | U.S.T.C. | T.F.C. | Krefeld | Spangler | Polyester/ cotton T.F.C. | Total |
|---|---|---|---|---|---|---|
| E | 8.4 | 28.2 | 65.3 | 60.5 | 26.3 | |
| (Reference) | (100%) | (100%) | (100%) | (100%) | (100%) | 500% |
| A | (126.1) | (100.7) | (48.1) | (79.3) | (105.7) | 459.9% |
| B | (148.7) | (102.1) | (53.1) | (84.8) | (108.7) | 497.4% |
| C | (223.7) | (133.0) | (78.6) | (78.5) | (131.1) | 644.9% |
| D | (176.1) | (113.4) | (87.3) | (66.6) | (135.0) | 578.4% |
| F | (145.2) | (119.9) | (102.5) | (105.5) | (133.5) | 606.6% |
| G | (72.6) | (87.6) | (57.4) | (91.7) | (39.2) | 348.5% |

From these two Tables, it is seen that the washing powders according to the present invention (A, B, C and D) have a detergency comparable with that of good commercial washing powders containing sodium tripolyphosphate (E and F) and markedly better than that of a commercial washing powder not containing sodium tripolyphosphate (G).

EXAMPLE 12

Soiled linen is washed ten times in succession in a washing machine, a control band of fabric according to the standard ISO No. 2267 being placed in the bath. The ash content, rate of soil redeposition and the rate of yellowing of the control band were then measured in the manner known in the washing powder industry.

Washing conditions are as follows:

Washing machine:

MIELE 416

Tap water of the town of Tienen, hardness 400 ppm of $CaCo_3$

Washing load:

4 kg (dry)

Soaking:

Amount of washing powder 125 g.

20 liters water

Maximum temperature: 30°C.

Time: 10 minutes

Washing:

Amount of washing powder 125 g.

15 liters water

Maximum temperature 85°C.

Time: 75 minutes

The powders according to the present invention which are used for these tests are powders A and B, while the powders E and F mentioned in Example 11 are used as the commercial reference powders.

The results obtained are as follows:

| Powder | Ash content | Rate of redeposition | Rate of yellowing |
|---|---|---|---|
| A | 0.08 | 8.2 | 2.2 |
| B | 0.08 | 11.0 | 1.4 |
| E | 1.99 | 9.9 | 1.3 |
| F | 3.41 | 13.0 | 3.5 |

From the ash content, it is thus seen that the powders according to the present invention prevent, to a remarkable extent, the deposition of calcareous matter on the linen and that, from the point of view of soil redeposition and yellowing, they can be compared with the best commercial washing powders, while causing minimum pollution of the residual water.

EXAMPLE 13

The following two formulations according to the invention can be used as water softening agents: (in percent by weight)

| | | |
|---|---|---|
| SPC Acid/Dobanol 91-6 EO | 5 | 20 |
| Anhydrous sodium sulfate | 95 | 80 |

The dose to be used varies from 1 to 10 g/liter depending on the hardness of water.

EXAMPLE 14

The following formulation is used as a scouring powder (in percent by weight)

| | |
|---|---|
| SPC Acid/Dobanol 91-6 EO | 4.5 |
| Anhydrous sodium sulfate | 20 |
| Borax | 5 |
| Sodium hypochlorite | 0.5 |
| Abrasive (diatomaceous earth) | 70 |

I claim:

1. A phosphate-free detergent composition, which comprises:

a. 1 to 30 parts by weight of a salt of an organic sulfopolycarboxylic acid, the carboxyl groups of which are at least partially esterified with at least one non-ionic compound containing at least one hydroxyl group and the sulfonic acid group of which is salified with a cation selected from the group consisting of sodium, potassium and triethanolamine, said sulfopolycarboxylic acid being obtained by sulfonating and acidifying the pyrolysis product prepared by heating an alkaline-earth metal salt of citric acid to a temperature within the range of 250° to 400°C for a period of time until an increase in titratable alkalinity of the reaction mixture is obtained and until not more than 32% by weight of the original citric acid salt remains in the reaction mixture, said non-ionic compound containing at least one hydroxyl group being selected from the group consisting of aliphatic alcohols containing from 4 to 24 carbon atoms alkoxylated with from 1 to 50 moles of a $C_2$–$C_3$ alkylene oxide per mole of aliphatic alcohol and alkylphenols containing from 8 to 15 carbon atoms in the alkyl chain alkoxylated with from 1 to 50 moles of a $C_2$–$C_3$ alkylene oxide per mole of alkylphenol, and b. 99 to 70 parts by weight of an alkali metal sulfate selected from the group consisting of sodium sulfate and potassium sulfate.

2. The detergent composition according to claim 1, which contains, in addition to components (a) and (b), at least one component selected from the group consisting of an anionic surfactant, a non-ionic surfactant, a bleaching agent, an alkali metal silicate, a stabilizer, a polyelectrolyte, adjuvants, water and an abrasive.

3. The detergent composition according to claim 1, which additionally contains, per 100 parts by weight of the sum of (a) and (b), 1 to 25 parts by weight of an anionic surfactant selected from the group consisting of alkali metal salts of fatty acids containing 10 to 30 carbon atoms, alkyl sulfonates containing 8 to 25 carbon atoms, secondary alkyl-sulfates containing 10 to 18 carbon atoms, alkylbenzene-sulfonates containing 10 to 18 carbon atoms, in the alkyl radical, primary alkyl sulfates containing 8–18 carbon atoms, alkylpolyoxyethylene-ether sulfates and alkylaryl-polyoxyethylene-ether sulfates the alkyl groups of which contain 8 to 18 carbon atoms and the polyoxyethylene groups of which contain 1 to 10 ethylene oxide units, and salts of a sulfopolycarboxylic acid the carboxyl groups of which are esterified with at least one non-ionic compound having at least one hydroxyl group and the sulfonic acid group of which is salified with a cation selected from sodium, potassium and triethanolamine, said sulfopolycarboxylic acid being selected from the group consisting of sulfosuccinic acid and sulfotricarballylic acid, said non-ionic compound having at least one hydroxyl group being selected from the group consisting of aliphatic alcohols containing from 4 to 24 carbon atoms alkoxylated with from 1 to 50 moles of a $C_2$–$C_3$-alkylene oxide per mole of aliphatic alcohol and alkylphenols containing from 8 to 15 carbon atoms in the alkyl chain alkoxylated with from 1 to 50 moles of a $C_2$–$C_3$ alkylene oxide per mole of alkylphenol.

4. The detergent composition according to claim 3, which contains, per 100 parts by weight of the sum of (a) and (b), 3 to 10 parts by weight of the anionic surfactant.

5. The detergent composition according to claim 1, which additionally contains, per 100 parts by weight of the sum of (a) and (b), 1 to 25 parts by weight of a non-ionic surfactant selected from the group consisting of alkylphenols containing 6 to 15 carbon atoms in the alkyl radical and ethoxylated with 3 to 50 moles of ethylene oxide per mole of alkylphenol, aliphatic alcohols containing 8 to 22 carbon atoms, ethoxylated with 3 to 50 moles of ethylene oxide per mole of alcohol, fatty acid ethanolamides containing 10 to 22 carbon atoms and fatty acid ethanolamides containing 10 to 22 carbon atoms ethoxylated with 0.5 to 20 moles of ethylene oxide per mole of ethanolamide.

6. The detergent composition according to claim 5, which contains, per 100 parts by weight of the sum of (a) and (b), 2 to 10 parts by weight of the non-ionic surfactant.

7. The detergent composition according to claim 1, which additionally contains, per 100 parts by weight of the total of (a) and (b), 1 to 35 parts by weight of a per compound selected from the group consisting of hydrogen peroxide, an alkali metal persulfate, an alkali metal percarbonate, an alkali metal persilicate, and an alkali metal perborate.

8. The detergent composition according to claim 7, which contains, per 100 parts by weight of the total of (a) and (b), 15 to 25 parts by weight of the per compound.

9. The detergent composition according to claim 1, which additionally contains, per 100 parts by weight of the total of (a) and (b), 1 to 10 parts by weight of an alkali metal silicate wherein the $SiO_2/M_2O$ ratio is from 1:4 to 4:1, M being a member selected from the group consisting of sodium and potassium.

10. The detergent composition according to claim 9, which contains, per 100 parts by weight of the total of (a) and (b), 3 to 6 parts by weight of the alkali metal silicate.

11. The detergent composition according to claim 1, which additionally contains, per 100 parts by weight of the total of (a) and (b), 0.1 to 10 parts by weight of a stabilizer selected from the group consisting of alkali metal salts of ethylenediaminetetraacetic acid, alkali metal salts of nitrilotriacetic acid, alkali metal salts of diethylenetriaminepentaacetic acid, alkali metal salts of hydroxypolycarboxylic acids, alkali metal salts of polycarboxylic acids and magnesium silicate.

12. The detergent composition according to claim 11, which additionally contains, per 100 parts by weight of the total of (a) and (b), 0.2 to 2 parts by weight of the stabilizer.

13. The detergent composition according to claim 1, which additionally contains, per 100 parts by weight of the total of (a) and (b), 0.1 to 5 parts by weight of a polyelectrolyte which is an alkali metal salt of polyacrylic acid, a maleic anhydride-ethylene copolymer, a maleic anhydride-methyl vinyl ether copolymer and/or an alkali metal salt of a polymerized hydroxycarboxylic acid.

14. The detergent composition according to claim 13, which contains, per 100 parts by weight of the total of (a) and (b), 0.5 to 3 parts by weight of the polyelectrolyte.

15. The detergent composition according to claim 1, which additionally contains, per 100 parts by weight of the total of (a) and (b), 0.1 to 15 parts by weight of at least one adjuvant selected from the group consisting of colouring matter, scent, a thickening agent, an optical whitening agent, an anticorrosion agent, an anti-dulling agent, an antifoaming agent, a pH buffer agent and a disinfectant.

16. The detergent composition according to claim 15, which contains, per 100 parts by weight of the total of (a) and (b), 0.2 to 10 parts by weight of the adjuvants.

17. The detergent composition according to claim 1, which additionally contains, per 100 parts by weight of the total of (a) and (b), 0.1 to 1000 parts by weight of water.

18. The detergent composition according to claim 1, which additionally contains, per 100 parts by weight of the total of (a) and (b), 2 to 950 parts by weight of water.

19. The detergent composition according to claim 1, which additionally contains, per 100 parts by weight of the total of (a) and (b), 0.1 to 1000 parts by weight of an abrasive selected from the group consisting of diatomaceous earth, volcanic ash, pumice stone, quartz, feldspar, marble, bentonite, sand and talc, in particles the grain size of which is lower than 80 microns.

20. The detergent composition according to claim 19, which contains, per 100 parts by weight of the total of (a) and (b), 5 to 950 parts by weight of the abrasive.

21. The detergent composition according to claim 1 in the form of a powder, a granulate, a gel, a paste, a solution, an emulsion or a suspension.

22. A water softening agent constituted by the detergent composition according to claim 1.

23. A scouring agent constituted by the composition according to claim 1.

24. A textile washing agent constituted by the composition according to claim 1.

* * * * *